US007017985B2

(12) United States Patent
Chen

(10) Patent No.: US 7,017,985 B2
(45) Date of Patent: Mar. 28, 2006

(54) FOLDING CHAIR WITH ARMS

(76) Inventor: Libin Chen, Qiaovu Building, Boyi Town, Ximenwai, Changzhou, Jiangsu 213147 (CN)

( * ) Notice: Subject to any disclaimer, the term of this patent is extended or adjusted under 35 U.S.C. 154(b) by 0 days.

(21) Appl. No.: 10/829,531

(22) Filed: Apr. 21, 2004

(65) Prior Publication Data

US 2004/0212224 A1 Oct. 28, 2004

(30) Foreign Application Priority Data

Apr. 21, 2003 (CN) ..... 03221267 U

(51) Int. Cl.
*A47C 4/00* (2006.01)
*A47D 1/02* (2006.01)

(52) U.S. Cl. ..... 297/56; 297/45; 297/35; 403/94; 403/400

(58) Field of Classification Search ..... 297/56, 297/55, 59, 16.1, 16.2, 35, 45; 403/94, 97, 403/400

See application file for complete search history.

(56) References Cited

U.S. PATENT DOCUMENTS 1,027,692 A * 5/1912 Cole ..... 297/45
2,787,316 A * 4/1957 Moore et al. ..... 297/56
3,836,194 A * 9/1974 Milette et al. ..... 297/55
5,058,948 A * 10/1991 Singer ..... 297/56
6,149,238 A * 11/2000 Tsai ..... 297/45
6,322,138 B1 * 11/2001 Tang ..... 297/45
6,488,331 B1 * 12/2002 Chen ..... 297/42
6,499,906 B1 * 12/2002 Zheng ..... 403/52
6,547,321 B1 * 4/2003 Wu ..... 297/16.1
6,595,582 B1 * 7/2003 Liu ..... 297/16.1
6,634,705 B1 * 10/2003 Zheng ..... 297/45
6,824,208 B1 * 11/2004 Zheng ..... 297/56
2002/0125744 A1 * 9/2002 Tseng ..... 297/16.1

FOREIGN PATENT DOCUMENTS

EP 640304 A1 * 3/1995

* cited by examiner

*Primary Examiner*—Peter M. Cuomo
*Assistant Examiner*—Stephen D'Adamo
(74) *Attorney, Agent, or Firm*—Martine Penilla & Gencarella LLP

(57) ABSTRACT

A folding chair with arms includes two back-rest tubes, two seating frame tubes, a pair of front crossed tubes, a pair of rear crossed tubes, a chair fabric, and a pair of soft or rigid arms. Each of the back-rest tubes is connected cross-wise to one of the seating frame tubes. The upper portion of each of the rear crossed tubes is connected to one of the back-rest tubes via a U-shaped hinging element. The front crossed tubes are cross-wise connected, and at the crossed connection point is provided a support reinforced block. The upper portion of each of the front crossed tubes is connected to one of the seating frame tubes via an eccentric U-shaped hinging element and a fixing element. The lower portion of each of the front crossed tubes is connected to the lower portion of one of the back-rest tubes via an eccentric U-shaped hinging element.

6 Claims, 7 Drawing Sheets

FOLDING CHAIR WITH ARMS

FIELD OF THE INVENTION

This invention relates to a folding chair with arms that is suitable for travel and leisure and that can be used in a courtyard and outdoors.

BACKGROUND OF THE INVENTION

The existing folding chair suitable for travel and leisure mainly has two structures. One uses an assembly-type structure composed of a plurality of U-shaped rectangular frames, with the fabric being able to be stretched tight. This is comfortable for sitting and leaning, but has a large volume when folded, and is thus inconvenient for carrying and depositing. The other uses a plurality of crossed supports connected together, and has a small volume when folded, but the fabric is unable to be stretched tight because the fabric is connected to the chair support via some fixing points. When a person sits on the chair, the chair will sink undesirably and for this reason is uncomfortable in use. In addition, the chair body support structure has poor strength and therefore can bear only a relatively small load. Thus, after a period of use or upon bearing a heavy load, the chair fabric is likely to tear. Furthermore, the existing folding chair has a large number of tubes and a complicated structure, thus using more materials and increasing production cost.

SUMMARY OF THE INVENTION

The present invention provides a folding chair with arms that overcomes the above-mentioned defects of conventional folding chairs. The chair has seating frame tubes and back-rest support tubes, with the chair fabric being sleeved over the seating frame tubes and the back-rest tubes. When a person sits in the chair, because of the weight of the human body, the chair fabric will be stretched tight along with the pressure upon the support, and will not loosen with increased use. The chair has a simple structure, with the supports being curved, thus presenting an attractive appearance.

In one embodiment, the folding chair includes back-rest tubes, seating frame tubes, front crossed tubes, rear crossed tubes, a chair fabric, and arms. Each of the back-rest tubes is cross-wise connected to one of the seating frame tubes, the upper portion of each of the rear crossed tubes is connected to the upper portion of each of the back-rest tubes via a U-shaped hinging element, and the lower portion of the each of rear crossed tubes is connected to the lower portion of one of the seating frame tubes via a U-shaped hinging element. The front crossed tubes are cross-wise connected, with a support reinforced block being mounted on the crossed connection point. The upper portion of each of the front crossed tubes is connected to the upper portion of one of the seating frame tubes via an eccentric U-shaped hinging element, and the lower portion of each of the front crossed tubes is connected to the lower portion of one of the back-rest tubes via a U-shaped hinging element. The chair fabric is sleeved over the seating frame tubes and back-rest tubes. Shoes are provided at the bottoms of the seating frame tubes and back-rest tubes.

The two arms may be soft or rigid. The soft arms are constructed by means of extending the top of the front crossed tube upward to form a curved support tube, with the arm fabric being sleeved on the top of the curved support tube, and its rear portion being fixed on the back-rest tube. On the other hand, when rigid arms are used, the lower portion of the front end of each of the rigid arms is connected to the support tube, and the other end of the support tube is connected to a fixing element which is fixed on the front end of the seating frame tube, and the rear portion of the rigid arm is fixed on the back-rest tube to form a quadrangular structure.

The eccentric U-shaped hinging element has a U-shaped hinging body, on which is provided a connection hole and a notch for inserting tubes. There is an eccentricity between the center of the hole and the center of the notch.

The folding chair with arms of this invention has the following features and advantages: reasonable design; simple structure; less material used and low cost; convenient folding, and attractive appearance because the support tubes are designed to a curved shape. Since the chair fabric is sleeved over the seating frame tubes and the back-rest tubes, when a person sits in the chair, the chair fabric will be stretched tight along with the pressure upon the support because of the weight of the human body, and will not loosen with increased use. A person feels comfortable and stable when sitting in the chair. The crossed connection point of the front crossed tube has a support reinforced block, and therefore the entire chair can bear a greater load.

To use the folding chair with arms of this invention, one can hold the back-rest tubes or the seating frame tubes and pull them apart, and thus the chair will be conveniently unfolded for use. To fold the folding chair, one just holds the back-rest tubes or the seating frame tubes and brings them together, and thus the chair will be folded into a package for carrying.

DETAILED DESCRIPTION OF THE INVENTION

Embodiments of the folding chair with arms of this invention will be described in conjunction with the drawings.

Figure 1B:
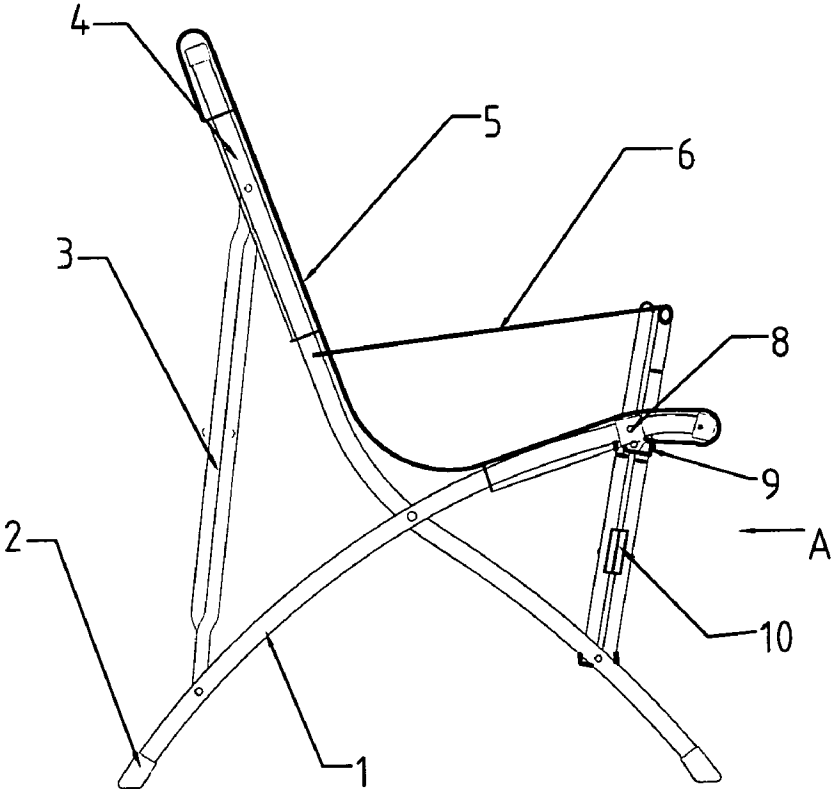
FIGS. 1A and 1B are schematic views of a folding chair according to one embodiment of this invention, wherein the arms are soft.
Figure 1A:
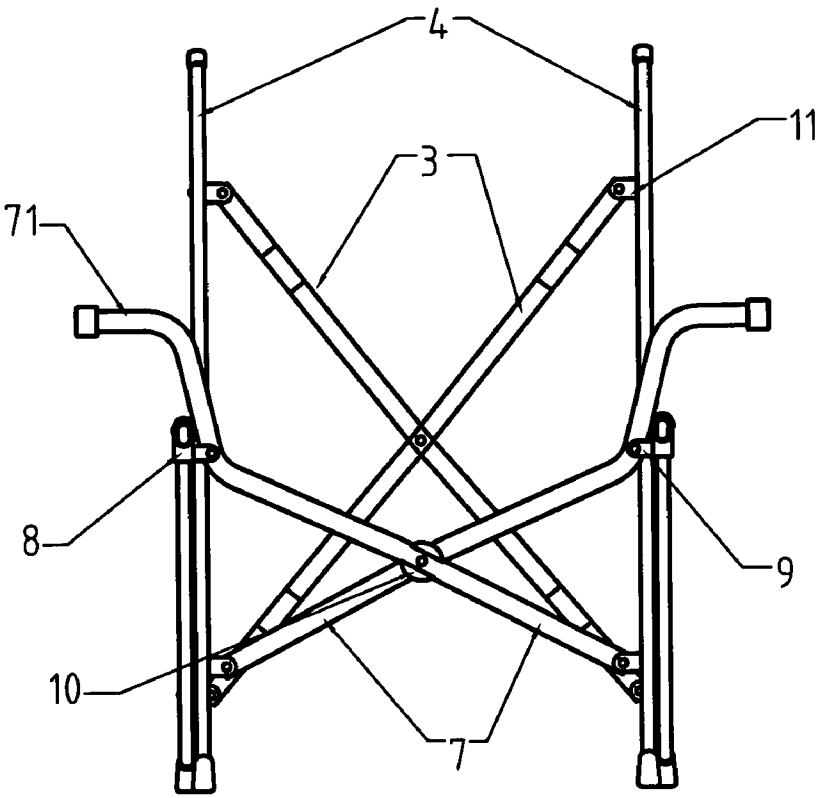
Figure 3:
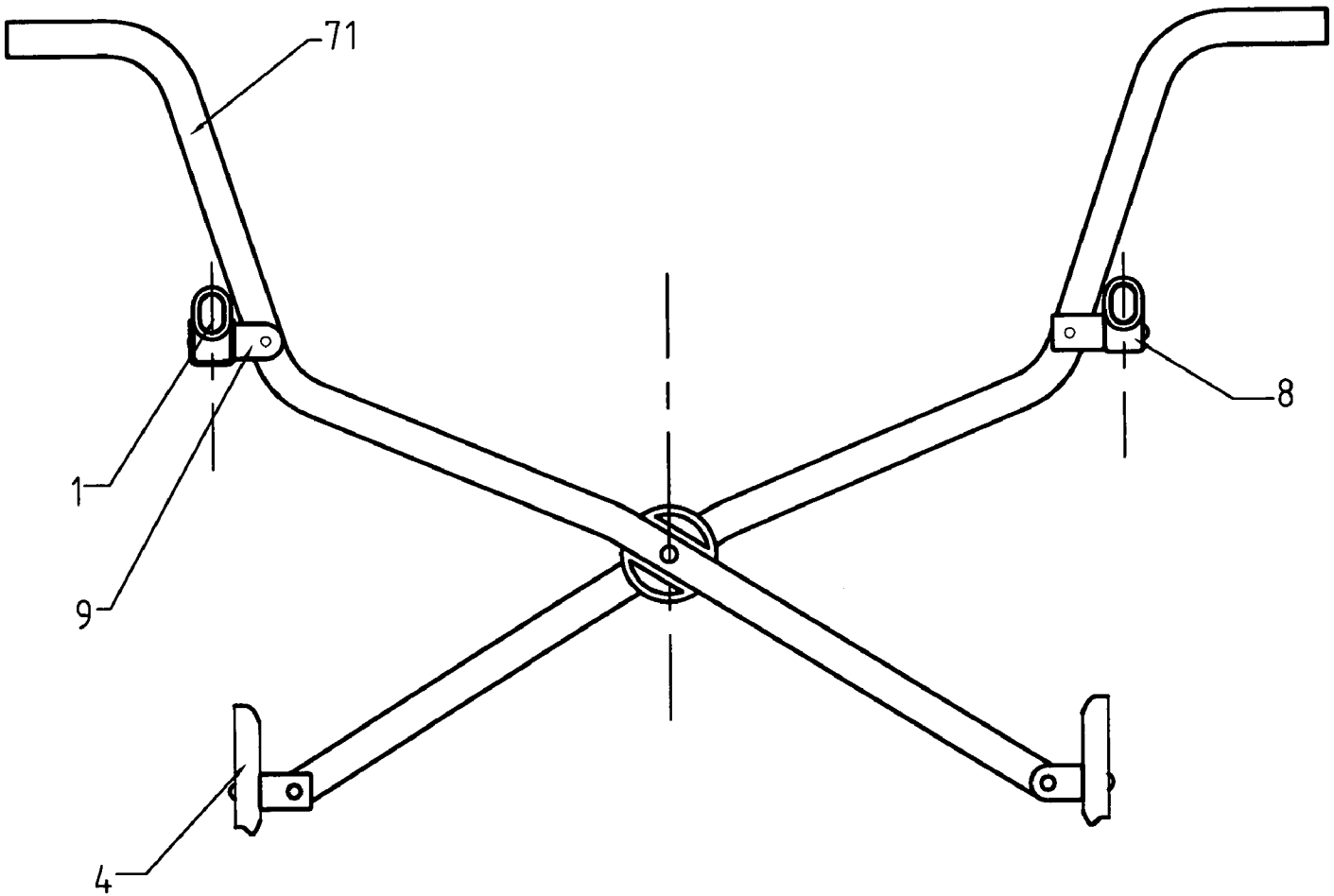
FIG. 3 is a schematic view of the connection of the front crossed tube and the extending portion of the arm in the folding chair with arms of FIG. 1 according to this invention.
Figure 4:
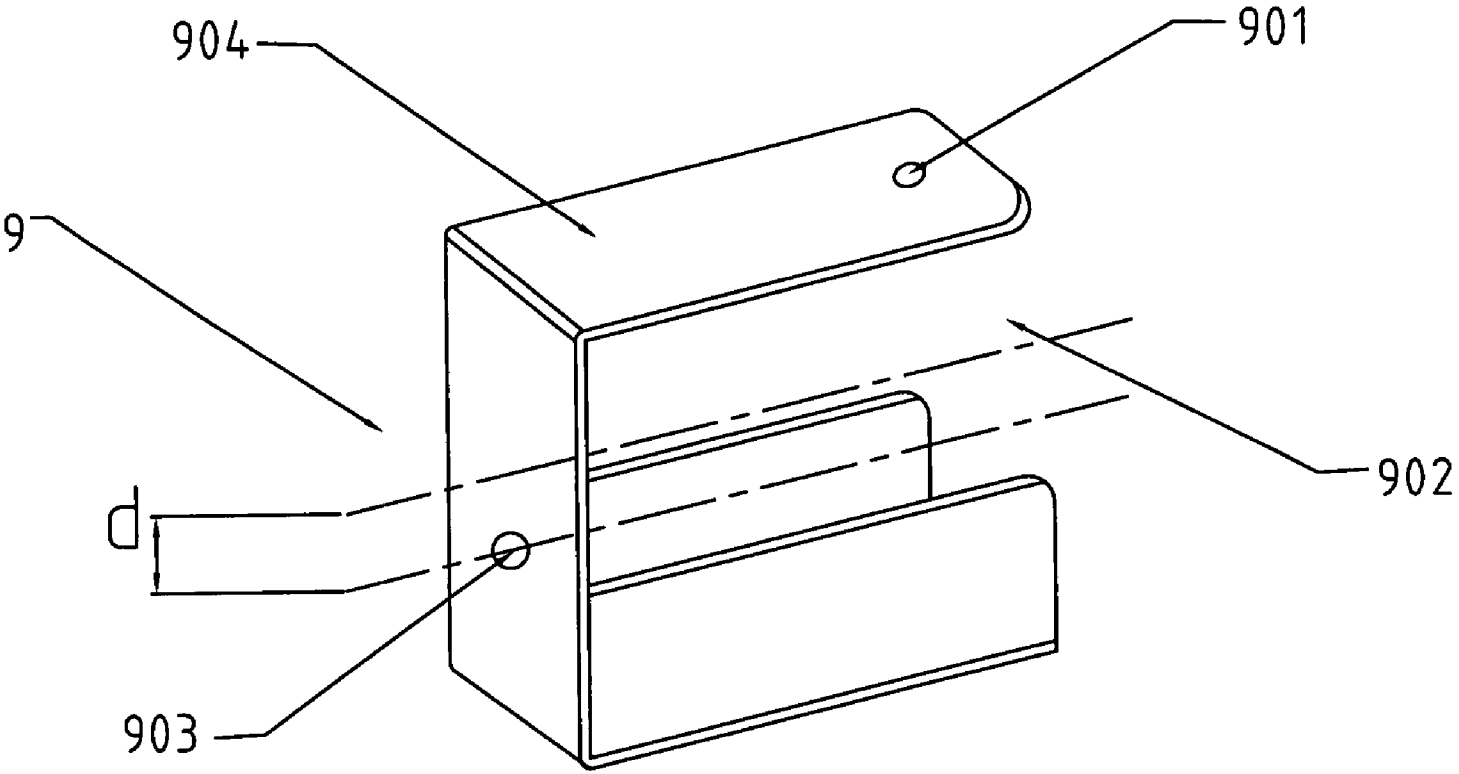
FIG. 4 is a schematic view of the U-shaped eccentric element in the folding chair with arms according to this invention.
Figure 5:
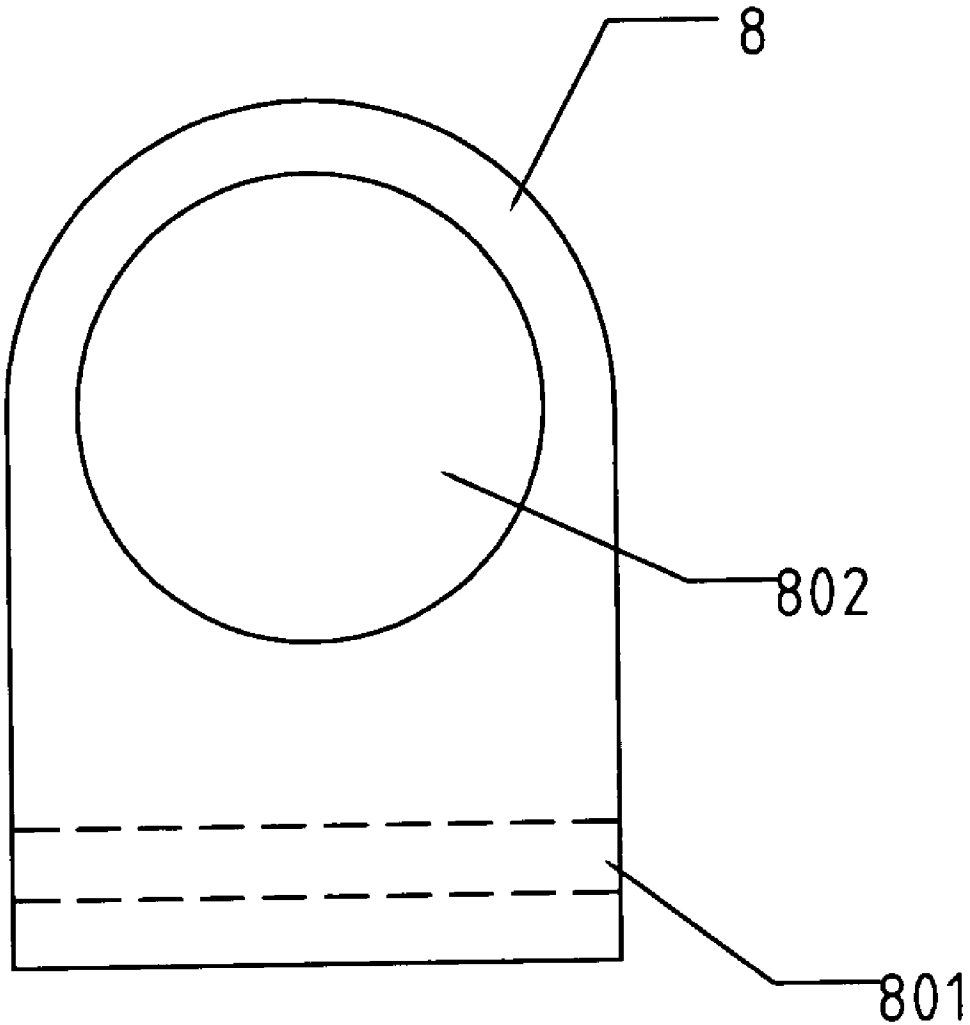
FIG. 5 is a schematic view of the fixing element in the folding chair with arms according to this invention.
Figure 6:
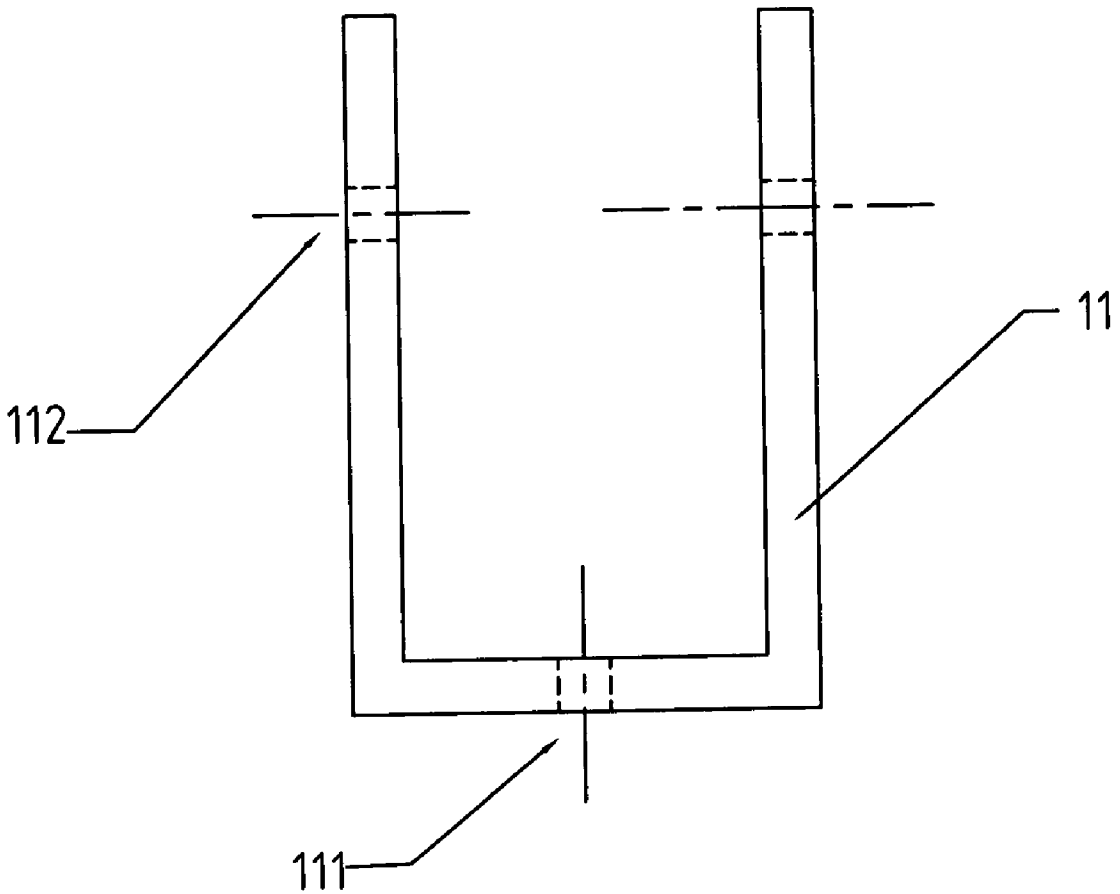
FIG. 6 is a schematic view of a U-shaped hinging element in the folding chair with arms according to this invention.

Referring to FIGS. 1A, 1B and 3, the folding chair with arms of this invention includes a back-rest tube 4, a seating frame tube 1, a rear crossed tube 3, a front crossed tube 7, an arm curved support tube 71, and a chair fabric. In this example, the arm is the soft arm 6. The structure of the chair with arms is symmetrical left-to-right. Two back-rest tubes 4 are cross-wise connected to two seating frame tubes 1, respectively, and rear crossed tube 3 is connected between the back-rest tube 4 and the seating frame tube 1. The upper portion of the rear crossed tube 3 is connected to the U-shaped notch of the U-shaped hinging element 11, which is riveted on the upper portion of the back-rest tube 4. Referring to FIG. 6, the U-shaped hinging element 11 has a riveting hole 111, which is used for the connection to the back-rest tube 4, and a pair of symmetrical hinging holes 112 is provided in the U-shaped wall. The lower portion of the rear crossed tube 3 is connected to the U-shaped hinging element 11, which is riveted to the lower portion of the seating frame tube 1. The two front crossed tubes 7 are cross-wise connected, and on the cross-wise connection point a support reinforced block 10 is provided. The upper portion of the front crossed tube 7 is connected to the U-shaped notch of the eccentric U-shaped hinging element 9. Referring to FIG. 4, the eccentric U-shaped hinging element 9 is connected to the riveting hole 801 of the fixing element 8. Referring to FIG. 5, the hole 802 on the fixing element 8 is sleeved over the seating frame tube 1. The lower portion of the front crossed tube 7 is connected to the lower portion of the back-rest tube 4 via the eccentric U-shaped hinging element 9. The upper portion of the front crossed tube 7 can extend upward to become curved, thus forming the curved support tube 71 of the soft arm.

Figure 7:
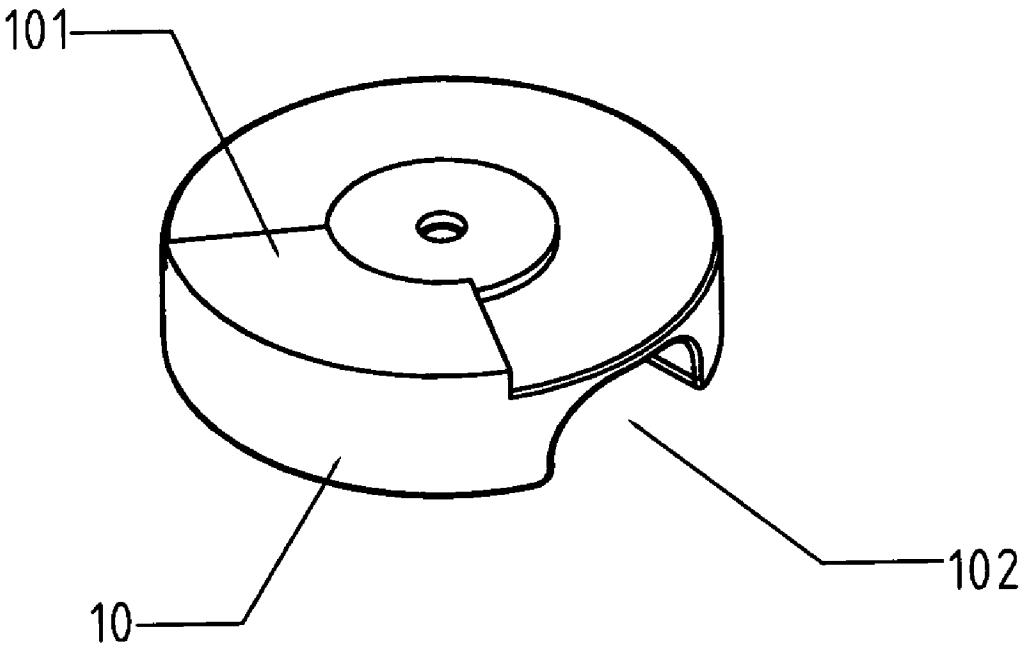
FIG. 7 is a schematic view of the support reinforced block in the folding chair with arms according to this invention.

Referring to FIG. 7, the reinforced block 10 is lid-shaped. A riveting hole is provided at the center of the reinforced block. A protrusion 101 is provided on the top of the reinforced block, and a positioning recess 102 is provided at the bottom of the reinforced block along the edge of the lid. The positioning recess 102 is fitted to the inside of the tube at the connection point of the front crossed tube 7, and the protrusions 101 of the two reinforced blocks 10 are disposed oppositely, and the rivet hole in the reinforced block is connected to the rivet hole in the tube crossing point via a rivet. When the front crossed tubes 7 are fully unfolded along with the entire chair, the edges of the protrusions 101 on the two reinforced blocks 10 will contact one another, thus fixing the support from declination, and thereby reinforcing the support. Shoes 2 are provided at the bottoms of the back-rest tubes 4.

FIG. 4 is a schematic view of the U-shaped eccentric element in the folding chair with arms according to one embodiment of this invention. The eccentric U-shaped hinging element 9 has a U-shaped hinging body 904, on which is provided a connection hole 903. The eccentric U-shaped hinging element 9 is hinged to the back-rest tube 4 and the seating frame tube 1 by a rivet. On the U-shaped hinging body 904 is also provided an insertion notch 902 and a hinging hole 901 for inserting and hinging the front crossed tube 7. There is an eccentricity "d" between the centers of the connection hole 903 and the insertion notch 902 so as to adapt to the installation and hinging of tubes having a certain curved shape.

The upper portion of the chair fabric 5 is sleeved over the back-rest tube 4, and the lower portion thereof is sleeved over the seating frame tube 1. The front end of the soft arm 6 is sleeved on the upper end of the arm support tube 71, and the rear end thereof is fixed on the back-rest tube 4. Alternately, a front end of a rigid arm is sleeved over the upper ends of said curved support tube 71, and a rear portion thereof is fixed on said back-rest tube 4.

Figure 2B:
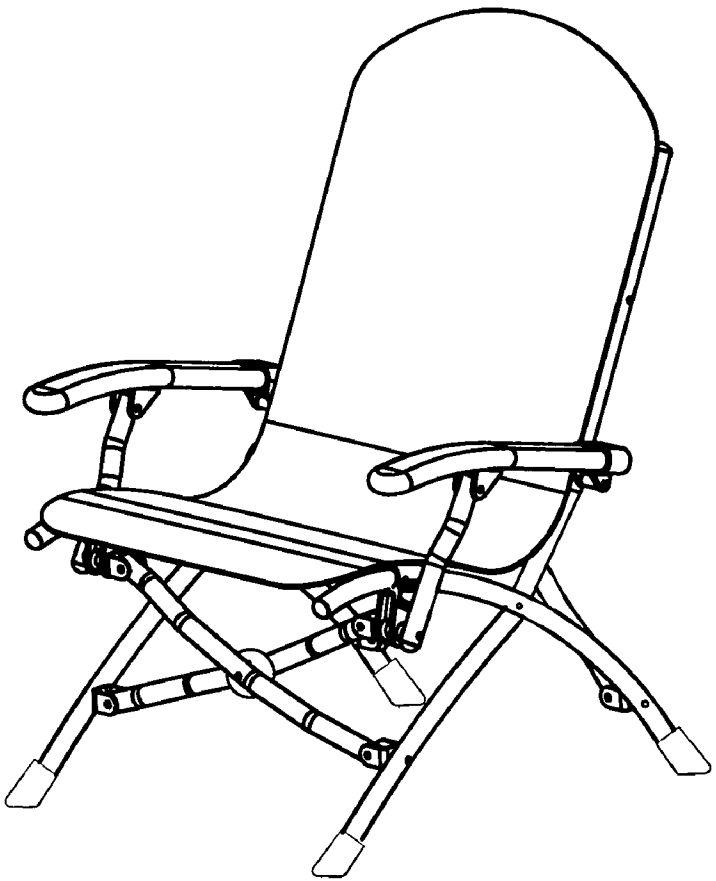
FIGS. 2A and 2B are schematic views of a folding chair according to another embodiment of this invention, wherein the arms are rigid.
Figure 2A:
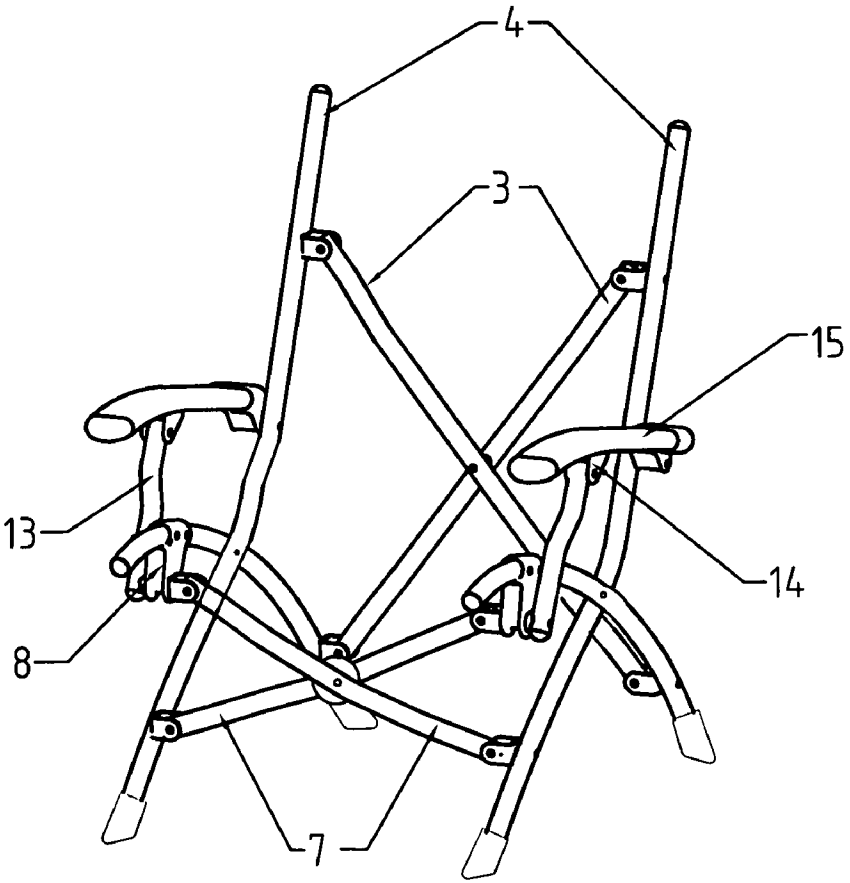

FIGS. 2A and 2B are schematic views of another embodiment of a folding chair according to this invention, wherein the arms are rigid. The main support structure is the same as that of the embodiment with soft arms. The upper end of the front crossed tube 7 does not extend upward to become a curved support tube, and another support tube 13 is connected to the outside of the fixing element 8, which is sleeved on the seating frame tube 1. The upper end of the support tube 13 is connected to the connection element 14 under the hard arm 15, and the rear end of the hard arm 15 is connected to the back-rest tube to form a quadrangular structure.

When the chair is folded, the support tube 13 will fall forward to enable the support tube 13 and the hard arm 15 to gather together, thus realizing a minimum package volume. When the chair is unfolded, the seating frame tube 1 and the back-rest tube 4 form a certain angle due to the fabric 5, and the support tube 13 and the hard arm 15 also form a fixed angle correspondingly, with the support tube 13 being vertical and the hard arm 15 being horizontal. When a person sits in and leans on the folding chair of this invention, the elbow may rest on the hard arm 15 horizontally.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A folding chair with arms, comprising:

two back-rest tubes, two seating frame tubes, two front crossed tubes, a pair of rear crossed tubes, a chair fabric, and a pair of arms, wherein a structure of said folding chair with arms is symmetrical left-to-right, each of said seating frame tubes is circular arc-shaped, with one end touching ground to serve as a rear support leg and the other end bending toward a front end of said folding chair with arms to serve as a support pole of a front seat, each of said back-rest tubes bending upward, with one end touching ground to serve as a front support leg and the other end bending upward to serve as a support pole of a backrest, each of said back-rest tubes is connected cross-wise to one of said seating frame tubes, an upper portion of each of said rear crossed tubes is connected to an upper portion of one of said two back-rest tubes via a first U-shaped hinging element, a lower portion of each the rear crossed tubes is connected to a lower portion of one of said two seating frame tubes via a second U-shaped hinging element, said two front crossed tubes are cross-wise connected, and at a joint connection of each of said front crossed tubes is disposed a reinforced block, each reinforced block being lid-shaped and having a rivet hole disposed in a center thereof, and each reinforced block having a protrusion disposed at an upper end thereof and a positioning groove disposed at a lower end thereof along a periphery of said reinforced support block, said positioning groove being fitted inside of a joint portion of the front crossed tubes, the protrusions of opposing reinforced blocks facing each other, and said rivet hole on each reinforced block being connected to a rivet hole of a tube crossing portion via a rivet, an upper portion of each of said front crossed tubes is connected to one of said seating frame tubes via a first eccentric U-shaped hinging element and a fixing element, a lower portion of each of said front crossed tubes is connected to the lower portion of one of said back-rest tubes via a second eccentric U-shaped hinging element, an upper portion of each of said front crossed tubes is provided with one arm of said pair of arms, and said chair fabric is sleeved over said seating frame tubes and said back-rest tubes.

2. A folding chair with arms according to claim 1, wherein each of the first and second eccentric U-shaped hinging elements has a U-shaped hinging body, and on said U-shaped hinging body is provided a connection hole and a tube insertion notch, such that there is an eccentricity between a center of said connection hole and a center of said tube insertion notch.

3. A folding chair with arms according to claim 1, wherein two identical reinforced blocks combined in a face-to-face relation are disposed at a crossed connection point, and when the chair is unfolded, the protrusions of said reinforced blocks come into contact with one another so as to support said two front crossed tubes.

4. A folding chair with arms according to claim 1, wherein the pair of arms may be soft or rigid.

5. A folding chair with arms according to claim 4, wherein the upper portion of each of said front crossed tubes extends upward to curved support tubes, the pair of arms is soft, front ends of said soft arms are sleeved over upper ends of said curved support tubes, respectively, and rear portions of said soft arms are fixed respectively on said back-rest tubes.

6. A folding chair with arms according to claim 4, wherein at a front outside of each of the seating frame tubes is provided another support tube, the another support tube being connected to an outside of the fixing element which is sleeved on each seating frame tube, an upper end of the another support tube being connected to a joint element which is fixed under a rigid arm, the rear portion of said rigid arm being fixed to said back-rest tube, thus forming a quadrangular structure together with said seating frame tubes and said back-rest tubes.

* * * * *